US006746133B2

(12) United States Patent
Loga et al.

(10) Patent No.: US 6,746,133 B2
(45) Date of Patent: Jun. 8, 2004

(54) LUMINAIRE

(75) Inventors: Simona Loga, Bregenz (AT); Georg Kempter, Bregenz (AT)

(73) Assignee: Zumitobel Staff GmbH, Dornbirn (AT)

( * ) Notice: Subject to any disclaimer, the term of this patent is extended or adjusted under 35 U.S.C. 154(b) by 0 days.

(21) Appl. No.: 10/217,445

(22) Filed: Aug. 14, 2002

(65) Prior Publication Data

US 2002/0191397 A1 Dec. 19, 2002

Related U.S. Application Data

(63) Continuation of application No. PCT/EP01/01270, filed on Feb. 6, 2001.

(30) Foreign Application Priority Data

Feb. 14, 2000 (DE) ..... 100 06 409

(51) Int. Cl.[7] ..... F21V 7/00

(52) U.S. Cl. ..... 362/147; 362/293; 362/217; 362/297

(58) Field of Search ..... 362/147, 293, 362/217, 247, 297, 343, 346

(56) References Cited

U.S. PATENT DOCUMENTS

| | | | | | |
|---|---|---|---|---|---|
| 4,768,140 | A | * | 8/1988 | Szpur | 362/342 |
| 4,937,714 | A | * | 6/1990 | Witt | 362/255 |
| 5,020,252 | A | * | 6/1991 | De Boef | 40/564 |
| 5,251,116 | A | * | 10/1993 | Wijbenga et al. | 362/308 |
| 5,790,329 | A | | 8/1998 | Klaus et al. | 359/887 |
| 5,931,567 | A | | 8/1999 | Salzmann et al. | 362/304 |
| 6,155,693 | A | | 12/2000 | Spiegel et al. | 362/147 |

FOREIGN PATENT DOCUMENTS

| | | |
|---|---|---|
| DE | 446406 | 6/1927 |
| DE | 3908148 A1 | 9/1990 |
| DE | 4443916 C1 | 5/1996 |
| DE | 19817384 A | 10/1999 |
| EP | 0574761 A1 | 12/1993 |
| NL | 17207 | 9/1927 |

* cited by examiner

*Primary Examiner*—Thomas M. Sember
(74) *Attorney, Agent, or Firm*—Fitzpatrick, Cella, Harper & Scinto

(57) ABSTRACT

A luminaire having a lamp (1) and at least one concavely curved reflector arranged, seen in the radiation direction, behind or to the side behind the lamp (1). To the side of the lamp (1) color filters (5) are so arranged that only the light radiated by the lamp (1) to the side against the at least one concave reflector (3) is altered in its color composition by means of the color filters (5). The light radiated in the radiation direction intended for the illumination is not altered in color.

11 Claims, 3 Drawing Sheets

LUMINAIRE

CROSS REFERENCE TO RELATED APPLICATIONS

This is a Continuation of International Application No. PCT/EP01/01270, filed Feb. 6, 2001 which in turn claims priority of German application DE 100 06 409.4, filed Feb. 14, 2000, the priority of both of which are claimed under 35 U.S.C. §§119 and 120. International Application PCT/EP01/01270 was published in German, but not in English, as WO 01/59365 A1 on Aug. 16, 2001.

BACKGROUND OF THE INVENTION

1. Field of the Invention

The present invention relates to a new luminaire for controlling the distribution of lights.

2. Description of the Related Art

Such a luminaire is described for example in DE 44 43 916 A1. There, below an elongate lamp, is first arranged a raster reflector consisting of side reflectors and transverse lamellae, with the aid of which the greater proportion of the light emitted by the lamp is directed and radiated downwardly without dazzle effect. The employment of such a raster reflector is of advantage for example in offices having a series of computer-screen work stations, since the light is to a certain degree freed from transverse dazzle and thus reflections on the screens can be avoided.

The luminaire described in the above-mentioned document further has an outer reflector onto which falls the light radiated from the lamp to the sides or upwardly. In this manner the region surrounding the lamp is additionally brightened, which on the one hand makes it possible easily to recognize whether the luminaire is switched on or not, but on the other hand it is also perceived by an observer as substantially more pleasant than the light of a pure raster luminaire, with which the entire light is radiated solely downwardly. Thereby, the outer reflector may have a diffusely reflecting surface, in order to attain a brightening of the region surrounding the lamp which is as uniform as possible. A further possibility consists however also in mounting below the outer reflector additionally a translucent (opalescent) plate.

SUMMARY OF THE INVENTION

It is an object of the present invention to improve such a luminaire in that with the luminaire new and optically appealing illumination effects can be attained.

The luminaire in accordance with the invention comprises a lamp and at least one concavely curved reflector arranged, as seen in a radiation direction of the lamp, behind or to the side behind the lamp. In accordance with the invention, color filters are so arranged to a side of the lamp that only the light which is radiated onto the concavely curved reflector is changed in its color composition, whereas in contrast light which is radiated from the lamp in the radiation direction is not influenced in its color composition by the filters.

Through this, the region surrounding the lamp appears in a different color, so that through the choice of a suitable filter various effects and moods can be created. For example, a substantially more pleasant atmosphere can be created in that the light directed onto the concave reflector is given a warmer color tone with the aid of the color filter for example colored slightly yellow or orange. In contrast, a more blue light is perceived, rather, as colder, for which reason it would suggest itself to employ a blue colored color filter in warmer regions. Since for the achievement of such illumination effects the concavely curved reflector need not itself be colored but can as usual be white, in the switched-off condition the region surrounding the lamp appears, as before, colorless or white, the above-described effects appear only in the switched-on condition of the lamp.

The alteration of the color composition of light by means of appropriate filters is already known from DE 39 08 148 A1 or DE 446 406. However, with the luminaire known from DE 39 08 148 A1 the entire light emitted by the lamp is to be changed in color. In DE 446 406 the light beams emitted in a certain direction encounter color filters, whereby a particular region of the room appears in a different color. In contrast, with the luminaire of the present invention, only the reflector arranged behind or to the side behind the lamp is to appear in another color, whereas in contrast the light proportion radiated in the radiation direction and employed for actual illumination remains unaltered in terms of color.

Further developments of the invention are described and claimed herein.

Since the color appearance of the concave reflector is brought about only by means of the color filter in accordance with the invention, the lamp can again be configured more flexibly in that the color filter can be altered in its effect. For example, there can be provided a mechanism which increases or reduces the filter effect of the color filter. With a lamp which is elongated along an axis, this can be effected for example in that the filter is rotatable around an axis running parallel to the lamp. The filter effect then depends upon the angle included between the color filter and the incident light in each case.

In a further development of the invention, there is provided a special configuration of the filter. By means of the side mounting of white transverse webs, the direct viewing of the filter element is prevented, so that upon observation of the overall luminaire only the concave reflector appears colored.

Preferably there is arranged before the lamp additionally a light distributor element, e.g. a raster, grid, perforated sheet or the like. Since the light emitted via this light distributor element remains unchanged in its color the luminaire in accordance with the invention again fulfils its main object, namely an effective illumination of the surrounding room.

With luminaires of this kind it is as a rule desired that the concavely curved reflector has a uniform light density over its entire width. In a further development of the invention various measures can thus be taken in order to attain a uniform light density. Normally, for this purpose the concave reflector has a curvature calculated in advance from theory, which however has the consequence that the reflector is then relatively high. In order then to configure the luminaire to be more flat in its entirety, it can be provided that a partially light permeable diffusor is arranged before the concave reflector, which diffusor to a certain degree brings about an equalization of the light density over the width of the reflector. This equalization can further also be supported in that the reflective capability of the reflector is different over its width, whereby the reflector has in its regions distant from the lamp a greater reflective capability than in the regions closer to the lamp. Further, there may be arranged to the side of the lamp further diffusers, or the color filter may be formed itself to be diffusely light permeable.

A further illumination effect can be attained in that the concave reflector is itself partially light permeable. If the luminaire is for example a surface-mounted luminaire or a hanging luminaire, the ceiling region above the luminaire is additionally brightened. This also then appears in a color tone corresponding to the color filter. In contrast thereto, it can also be provided that although the concave reflector is partially light permeable, there is however arranged above this reflector at least one further lamp. This may in turn likewise be surrounded by a color filter, so that a plurality of different illumination effects can be attained with different color tones.

Along with the two above-mentioned examples of a ceiling surface-mounted luminaire or a hanging luminaire, the luminaire in accordance with the invention can be configured also as a recess luminaire or in other forms.

BRIEF DESCRIPTION OF THE DRAWINGS

Below, the invention will be described in more detail with reference to the accompanying drawings.

DETAILED DESCRIPTION OF THE PREFERRED EMBODIMENTS

Figure 1:
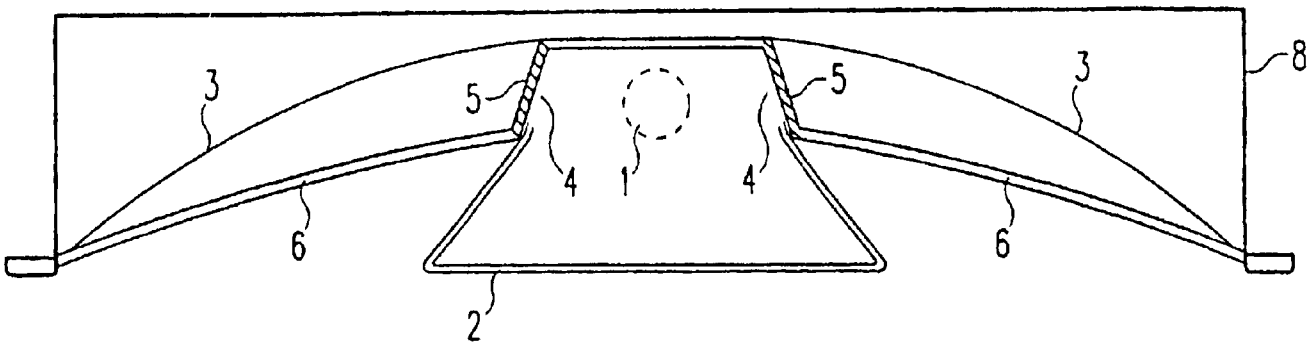
FIG. 1 is a diagrammatic transverse cross-section of a first exemplary embodiment of a luminaire in accordance with the invention, in the form of a recess luminaire.

With the ceiling recess luminaire illustrated in FIG. 1, the individual components of the luminaire are arranged within a box-like container 8, which upon installation of the luminaire may be sunk into a ceiling. In the present case a rod-shaped lamp 1, for example a gas discharge lamp, serves as a light source. The lamp 1 is elongated along an axis 1*a*. Before this lamp 1 there is arranged, as light distributor element, a raster 2 comprising side reflectors and transverse lamellae, via which the greater part of the light emitted by the lamp 1 is radiated downwardly. The concrete form of the raster 2 can be so selected that the light is to a certain degree freed of transverse dazzle effects. Alternatively thereto there can be employed instead of a raster also a perforated sheet or another optical element—for example a diffusor or a prism structure.

Further, the lamp 1 is spanned by a concavely curved reflector 3, having side wings which are arranged in substance neighboring the lamp 1. Between this reflector 3 and the upper edge of the raster 2 there are formed light entry regions 4 arranged neighboring the lamp 1, via which light entry regions a small part of the light emitted by the lamp 1 is directed onto the reflector 3. Preferably, this reflector 3 has a white surface.

Within the light entry regions 4 there are arranged two color filters 5, which change the color tone of light from the lamp 1 which is directed onto the concave reflector 3. After the switching on of the lamp 1 the region below it is brightened as usual by the light radiated downwardly directed via the raster 2 and not altered in terms of color, whereas the reflector 3 is brightened in a color tone—for example blue—corresponding to the filters 5.

The luminaire illustrated in FIG. 1 has merely a slight height, and therefore a uniform light density cannot be attained over the entire width of the reflector 3 merely by means of the curvature of the reflector 3. For this reason there is arranged before the concave reflector 3 a partially light permeable diffusor 6, with the aid of which the regions surrounding the lamp 1 appear in a somewhat more uniform light density. In order further to encourage the equalization of the light density over the width of the reflector 3 or of the diffusor 6 the two filters 5 may further be so configured that they for example preferably direct the light onto regions of the reflector 3 more distant from the lamp 1. In addition, two colored diffusors may be employed as color filters 5. With the aid of the measures just described it can be attained that despite the slight height of the luminaire a relatively unitary light density is attained for the region surrounding the lamp 1.

Figure 2:
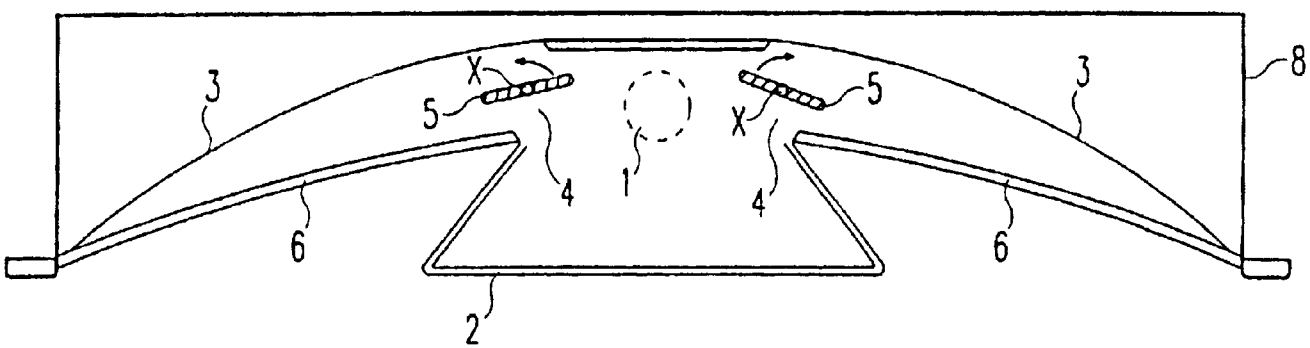
FIG. 2 is a view similar to FIG. 1 but showing development of the luminaire with variable color filters.

In the exemplary embodiment illustrated in FIG. 1 the two color filters 5 are fixedly mounted in the luminaire and are not variable in their effect. In contrast thereto, with the exemplary embodiment illustrated in FIG. 2, the filter effect and thus the color intensity of the light directed onto the reflector 3 can be varied. This is effected in that the two color filters 5 are mounted to be rotatable about an axis X running parallel to the lamp 1. Depending upon the disposition of the color filters 5 the two light entry regions 4 are then effectively covered to a certain degree by means of the filters 5. By means of rotation of the filters the proportion of the light altered in color can be varied, whereby in the extreme case the filter effect can be virtually completely suppressed so that the reflector 3 appears white.

The alteration of the disposition of the two color filters 5 can be effected for example by a controller connected with the light switch for the luminaire. The configuration illustrated in FIG. 2 for the variation of the filter effect is advantageous insofar as no additional space is needed for the rotation. In addition, the two color filters 5 are displaceable perpendicularly to the lamp axis upwardly and removed from the light entry regions 4. This configuration even offers the possibility of employing a plurality of color filters of different colors or other different optical properties, which can be brought as desired into the two light entry regions 4

Figure 3:
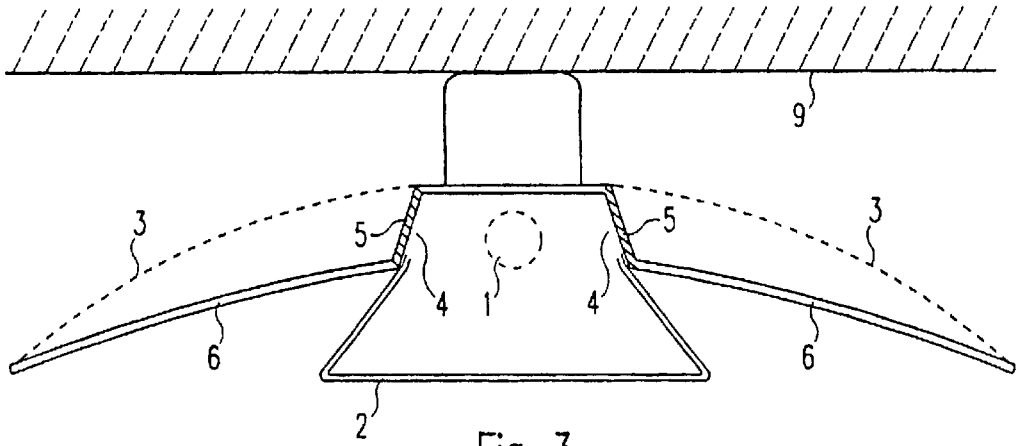
FIG. 3 is a view similar to FIG. 1, but showing an exemplary embodiment of a ceiling surface-mounted luminaire in accordance with the invention.

FIG. 3 shows a further exemplary embodiment in which the luminaire in accordance with the invention is configured as a ceiling surface-mounted luminaire. With regard to its structure, the luminaire illustrated in FIG. 3 is very similar to the two above-described luminaires. The main difference is that the reflector 3 is additionally formed to be partially light permeable. This has the consequence that the light which is altered in color by means of the color filters 5 and directed onto the reflector 3 is not only radiated downwardly via the reflector 3 and the diffusor 6 but is additionally employed to brighten the ceiling region 9 above the luminaire, whereby a further appealing illumination effected is provided. With this exemplary embodiment also it can be provided, as in FIG. 2, that the two color filters 5 are mounted rotatably around an axis X, in order to set the filter effect as desired.

Figure 4:
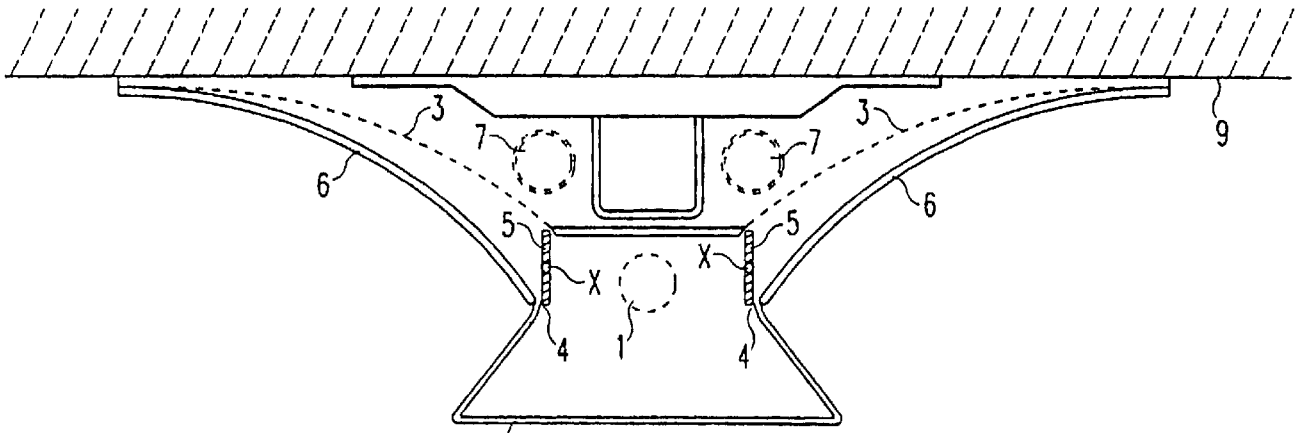
FIG. 4 is a view similar to FIG. 1, but showing a further exemplary embodiment of a luminaire in accordance with the invention and having additional lamps arranged behind the concave reflector.

In FIG. 4 there is illustrated a further luminaire in accordance with the invention, which is likewise configured as ceiling surface-mounted luminaire but has a different reflector form. The reflector 3 is in this example no longer formed in one piece but consists of two concavely curved side wings 3 which extend to the side towards a ceiling 9 on which the luminaire is mounted. In this case also there are formed between the upper edge of the raster 2 arranged below the lamp 1 and the two side wings of the reflector 3 two light entry regions 4 in which, in accordance with the invention, two color filters 5, also rotatable around an axis X, are mounted. The two diffusors 6 arranged before the reflector 3 also extend from the light entry regions 4 to the ceiling 9.

The second reflector 3 is again formed to be partially light permeable, whereby in this case this measure does not however serve for brightening the ceiling. Instead, in the two regions behind the reflector 3 there are arranged further lamps 7. The light of these two additional lamps 7 can also likewise be employed in order to additionally brighten the region surrounding the lamp 1, however in the color of the light emitted by the two lamps 7. These two lamps 7 also may be surrounded by a non-illustrated color filter, so that by means of a suitable control or dimming of the lamps 1 and 7 different illumination effects can be achieved.

Figure 5:
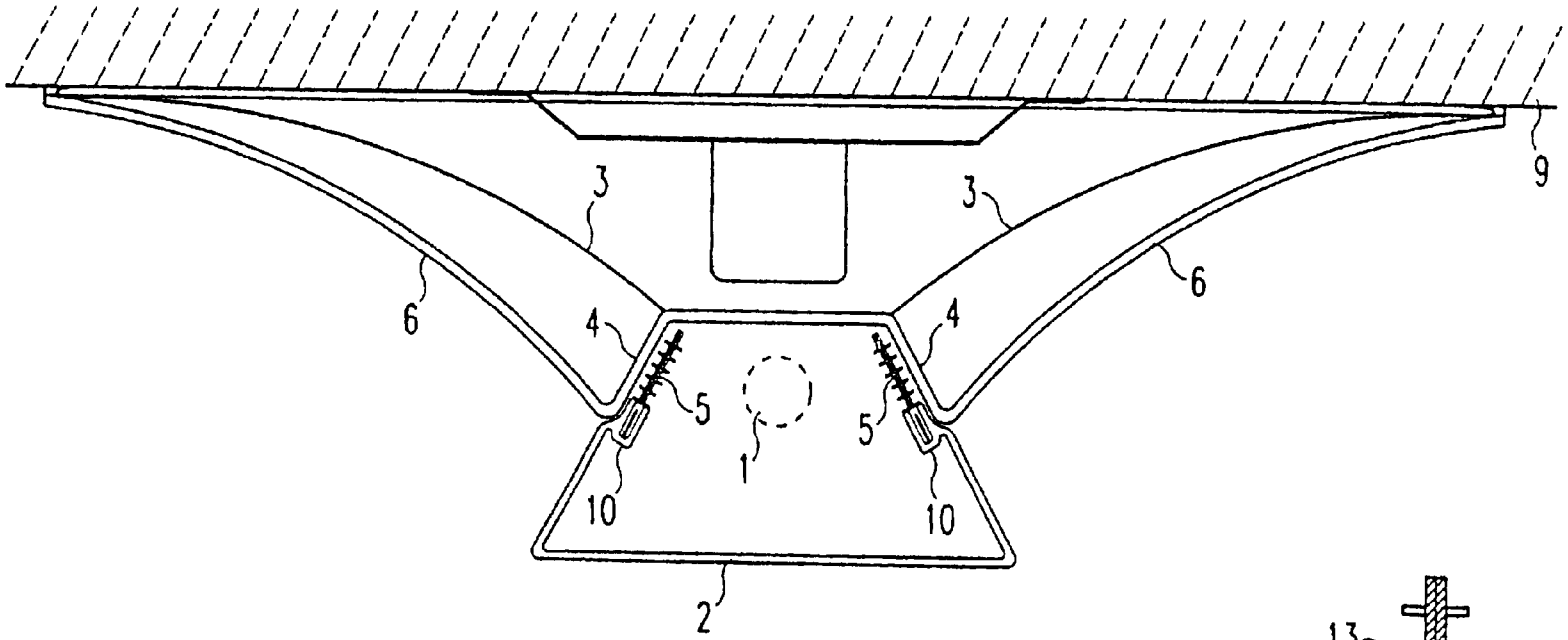
FIG. 5 is a view similar to FIG. 1 and showing a luminaire in accordance with the invention having specially configured color filters.

Finally, there is illustrated in FIG. 5 a further luminaire in accordance with the invention, which in terms of its structure is the same as the luminaire in FIG. 4, but has however no partially light permeable reflector 3 and thus also no additional lamp. The light distributor element 2 configured in the present example as diffusor, has here at its two upper ends two elongate fittings 10 into which the two color filters are placed. This mounting makes possible a very simple exchange of the color filters 5.

Figure 6:
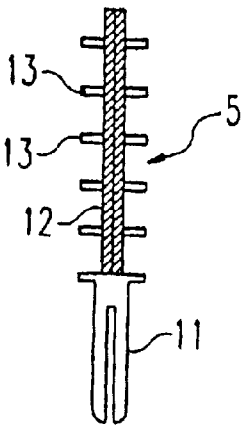
FIG. 6 is an enlarged cross-sectional view of a color filter used in the embodiment of FIG. 5.

The detailed structure of the color filter 5 shown in FIG. 5 is illustrated in FIG. 6. The mounting element 11 of the color filter 5 to be inserted in the fitting 10 is preferably, as is the light distributor element 2 configured as diffusor, opalescent white, in order to have no disruptive influence on the lighting effects. Only above the mounted element 11 is the actual filter element 12, for example colored blue, located. In the section in which the filter effect comes to bear, there are further provided transverse webs 13. These transverse webs 13 are white and serve to prevent or minimize direct viewing from below onto the blue filter element 12. By these means it is ensured that upon observation of the entire luminaire only the concave reflector 3 appears colored.

Of course, the forms of luminaire illustrated in FIGS. 4 and 5 can be configured as hanging luminaires or suspended luminaires, whereby then there need not necessarily be present further lamps 7 above the reflector 3, but again the ceiling region 9 may be brightened by means of the light thrown via the lamp entry regions 4 onto the reflector 3. Further, the luminaires illustrated in FIGS. 1 to 5 can also be configured as suspended luminaires for lighting track systems or other ceiling systems. Neither need the lamp necessarily be a rod-like elongate lamp. For example, the entire luminaire may also be circular or elliptical.

The luminaire in accordance with the invention distinguishes itself in that with the aid of few and simple additional means new and optically appealing illumination effects can be achieved. Further, the additionally proposed measures make it possible that over the width of the concave reflector a uniform light density is achieved and despite this the lamp can be configured to be relatively flat.

What is claimed is:

1. A luminaire comprising:

a lamp, which is elongated along an axis thereof and which is arranged to emit light in a radiation direction;

at least one concavely curved reflector arranged at a respective side region relative to said lamp, as said lamp is viewed from along the radiation direction, wherein said reflector includes side wings arranged near said lamp;

at least one color filter positioned relative to said lamp such that only light that is radiated from said lamp in a direction toward said reflector becomes altered in its color composition by said color filter, while light radiated from said lamp along the radiation direction is not altered by said color filter; and a partially light-permeable diffuser arranged in front of said reflector as viewed from along the radiation direction.

2. A luminaire according to claim 1, wherein said color filter is variable in its filter effects.

3. A luminaire according to claim 2, wherein said color filter is rotatable about an axis parallel to the axis of said lamp.

4. A luminaire according to claim 2, wherein said color filter is displaceable in a direction perpendicular to the axis of said lamp.

5. A luminaire according to one of claims 2, 3 or 4, wherein a plurality of said color filters with different optical properties are arranged to be selectively displaceable in a direction perpendicular to the axis of said lamp.

6. A luminaire according to one of claims 2, 3 or 4, wherein said color filter is a color diffusor.

7. A luminaire according to claim 6, wherein regions of said reflector that are more distant from said lamp have a higher reflective capability than regions of said reflector that are closer to said lamp.

8. A luminaire according to one of claims 2, 3 or 4, wherein said reflector has reflective capabilities that are different over its width.

9. A luminaire according to one of claims 2, 3 or 4, further comprising a light distributor element arranged along said radiation direction, wherein said lamp is arranged between said light distributor element and said reflector.

10. A luminaire according to claim 9, wherein said light distributor element is a raster.

11. A luminaire according to claim 9, wherein said light distributor element is a perforated sheet.

* * * * *

UNITED STATES PATENT AND TRADEMARK OFFICE

CERTIFICATE OF CORRECTION

PATENT NO. : 6,746,133 B2
DATED : June 8, 2004
INVENTOR(S) : Simona Loga et al.

It is certified that error appears in the above-identified patent and that said Letters Patent is hereby corrected as shown below:

Title page,
Item [73], Assignee, "Zumitobel" should read -- Zumtobel --.

Signed and Sealed this

Thirtieth Day of November, 2004

JON W. DUDAS
*Director of the United States Patent and Trademark Office*